United States Patent [19]

Muller et al.

[11] Patent Number: 4,757,569

[45] Date of Patent: Jul. 19, 1988

[54] PROCESS AND APPARATUS FOR REMOVING FILMS OF FLOW AGENT CLINGING TO MOVING STRIP MATERIAL

[75] Inventors: Eduard Muller, Olpe; Heinz Steiner, Kirchhundem, both of Fed. Rep. of Germany

[73] Assignee: Josef Frohling GmbH Walzwerksmachinenbau, Olpe, Fed. Rep. of Germany

[21] Appl. No.: 837,029

[22] Filed: Mar. 6, 1986

[30] Foreign Application Priority Data

Mar. 6, 1985 [DE] Fed. Rep. of Germany ..... 3507936

[51] Int. Cl.[4] ..... B08B 5/02

[52] U.S. Cl. ..... 15/306 A; 15/308; 15/401

[58] Field of Search ..... 15/306 A, 308, 401

[56] References Cited

U.S. PATENT DOCUMENTS

| | | | |
|---|---|---|---|
| 1,945,274 | 1/1934 | Hormel | 15/308 X |
| 2,289,753 | 7/1942 | Capstaff | 15/306 A |
| 2,472,596 | 6/1949 | Kunz | 15/306 A X |
| 2,648,089 | 8/1953 | Mayer | 15/316 R X |
| 3,195,163 | 7/1965 | Townley et al. | 15/306 A |
| 3,528,121 | 9/1970 | Krause | 15/308 |
| 3,546,733 | 12/1970 | Johnson | 15/308 |
| 4,279,055 | 7/1981 | Jaggi et al. | 15/306 A X |

*Primary Examiner*—Chris K. Moore

*Attorney, Agent, or Firm*—Fleit, Jacobson, Cohn & Price

[57] ABSTRACT

A process for the removal of films of flow agent from moving strip material, by squeezing away the film by means of squeeze rollers and an air flow duct which each extend transversely with respect to the forward feed direction of the strip material. The air flow is directed along the squeezed-away cushion of flow agent, and entrains the cushion of flow agent. Apparatus which is used in the process includes air flow ducts which extend transversely with respect to the forward feed direction of the strip material, and which are positioned at the point of entry of the strip material into the squeeze region.

9 Claims, 3 Drawing Sheets

PROCESS AND APPARATUS FOR REMOVING FILMS OF FLOW AGENT CLINGING TO MOVING STRIP MATERIAL

BACKGROUND OF THE INVENTION

1. Field of the Invention

The invention relates to a process for removing films of flow agent which cling to moving strip material, in particular of metal. The invention further relates to an apparatus for carrying out that process.

2. Description of the Related Art

Before or during the treatment of moving strip material, for example by rolling, longitudinal cutting, milling etc., it is known that oils, aqueous emulsions or similar flow agents for lubricating or cooling the strip material are applied to the surface of the strip in the processing zone. Even if the major part of the flow agent applied runs off the strip at the side thereof after the processing operation has been carried out, nonetheless there is always still an undesirably large amount of flow agent that remains clinging in the form of a film to the surface of the strip, which causes a great deal of problems and gives rise to difficulties when the processed strip is wound up to form a coil, or is used in subsequent treatment operations (for example annealing or pickling).

Therefore, attempts have already been made to remove the undesired film of flow agent from the surface of the strip by scraper blades of flexible material such as plastics material. When the processed strip is passed between two such blades which come together at their edges, the edges of the blades act as sealing lips and hold back the cushions of flow agent which collect in front of the blades on the top and underside of the strip, the cushions of flow agent then finally dripping off.

However the use of such scraper blades is in no way devoid of problems for, when dealing with surfaces of soft sensitive material, it gives rise to the formation of grooves, scratches and similar surface damage. In addition, the scraper blades are only effective at a relatively low speed of movement of the strip. When the speed of the strip is increased beyond a certain level, the amount of flow agent that ultimately collects in front of the sealing lips is greater than the amount which can drip away in the same amount of time, which means that such devices do not effectively remove the flow agent.

It is also known for moving strips having flow agent films to be passed between pairs of squeeze rollers. Although when that is done the danger of damaging sensitive strip material does not occur, nonetheless at high speeds of movement of the strip, the removal effect is lost for the same reasons as when using sealing lips.

Two pairs of scraper blades have also already been arranged at a defined spacing from each other in the direction of movement of the strip, and extending transversely with respect to the top and underside of the strip, with a vacuum being applied to the space between the two pairs of scraper blades. Although that arrangement provides effective removal of the flow agent even at higher speeds of movement of the strip, nonetheless the disadvantage of scratching sensitive surfaces of strip material still remains. It has therefore hitherto not yet been possible satisfactorily to solve the problem of removing a film of flow agent from treated moving strip material under a wide range of operating conditions.

SUMMARY OF THE INVENTION

The invention therefore seeks to provide a process and an apparatus with which not only is a film of flow agent clinging to moving strip material substantially removed, even when dealing with strips moving at high speed, but at the same time the danger of doing any damage to soft sensitive strip surfaces is also reliably eliminated.

Briefly stated, in accordance with one aspect of the present invention, a process is provided for removing films of flow agent clinging to moving strip materials. The process according to the invention is characterised in that the films of flow agent are squeezed away from the top and underside of the strip and air flows are directed against the squeezed-away cushions of flow agent which are formed, said air flows extending transversely with respect to the forward feed of the strip material and entraining the flow agent cushions.

Further subject-matter of the invention is an apparatus for carrying out the above-specified process, comprising rollers for squeezing away the films of flow agent that cling to the moving strip material, the apparatus according to the invention being characterised in that air flow ducts extending transversely with respect to the forward feed of the strip material are provided at the points of entry of the strip material into the squeeze regions, wherein in said regions the surface of both the strip material and the squeeze rollers form parts of the walls of the air flow ducts.

Preferably, the apparatus according to the invention has blocks of metal or plastics material with openings whose bottoms are rounded or curved and adapted to conform substantially with the periphery of the squeeze rollers, the squeeze rollers resting in said openings. The flat exposed side walls of the openings, insofar as they are disposed upstream of the squeeze rollers in the direction of movement of the strip material, form in that arrangement the supplementing wall portion constituting an air flow duct, that is to say that portion which during operation of the apparatus is not formed by strip and roller surfaces. A longitudinal groove may be provided in that exposed surface, in order to increase the cross section of the air flow duct. The groove may extend over only a part of the length of that surface, which extends in a direction transverse to the direction of strip movement, but it may also extend over the entire length of the surface.

It is also possible, however, for the squeeze rollers to have mounting spindles, which for example are mounted in the blocks in such a way that a clearance space is provided between the rounded bottoms of the openings and the surfaces of the squeeze rollers. In that case, one or more additional flow ducts are provided in the region of the rounded bottoms of the openings which extend transversely with respect to the forward feed of the strip material, for entraining the flow agent residues which still cling to the surface of the rollers after the operation of squeezing the strip and are thrown off by centrifugal force.

The squeeze rollers at the top and the underside of the strip may be disposed in mutually opposing relationship, but they can also be disposed in displaced relationship relative to each other, in the direction of movement of the strip. Further, they extend at least over the entire width of the strip material to be treated, in order to be able to be fully effective.

The air flows which are directed against the squeezed-away cushions of flow agent, in the air flow ducts, may be produced by compressed air, but preferably they are generated by a suction means. The flow agent-air mixture which is discharged from the air flow ducts can then be passed to a downstream-disposed filter or cyclone so that the flow agent and the air can be separated from each other again.

The air flows may pass into the air flow ducts at one edge of the strip and come out again at the other edge. Preferably however the air is supplied from both edges of the strip and is discharged at the middle of the strip (or vice-versa), for which purpose there is then provided a particular conduit which opens into the middle of an air flow duct.

BRIEF DESCRIPTION OF THE DRAWINGS

The invention will now be described in greater detail with reference to the accompanying drawings showing preferred embodiments of the subject-matter of the invention. In the drawings.

DESCRIPTION OF THE PREFERRED EMBODIMENTS

Figure 1:
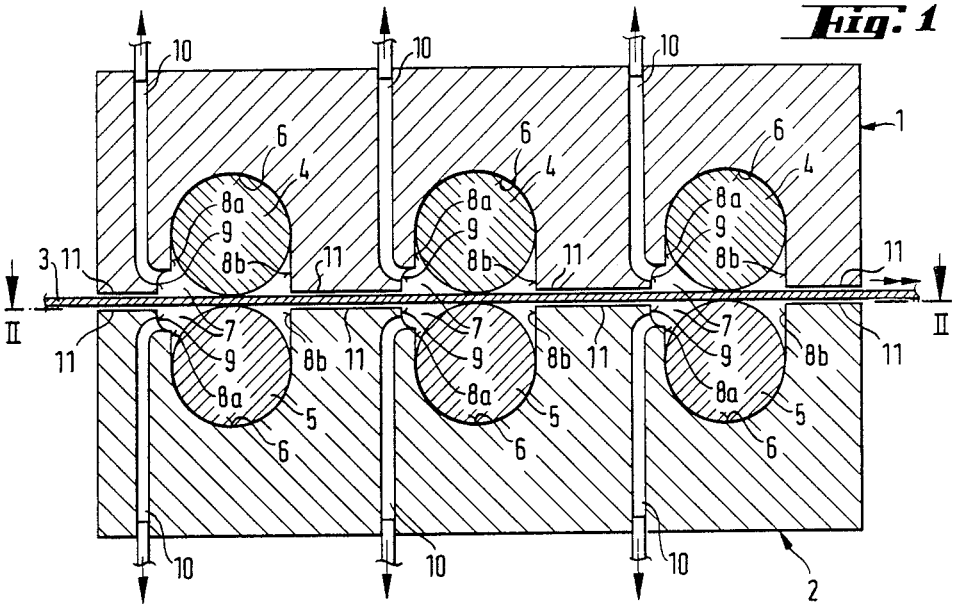
FIG. 1 is a diagrammatic view in longitudinal section through a film removal apparatus in accordance with the present invention.

Referring now to the drawings, FIG. 1 shows an upper block 1 and a lower block 2. The blocks are provided with recesses or openings 6 in which squeeze rollers 4 and 5 are received. The base or innermost surfaces of the openings 6 are provided with curved or rounded portions which correspond to the outside diameter of the rollers 4 and 5 so that the rollers are adjacent to the rounded portions of the recesses. The blocks 1 and 2 with their rollers 4 and 5 are arranged one above the other in such a way that the upper rollers 4 and the lower rollers 5 are in mutually opposing relationship, the spacing of the blocks from each other depending on the thickness of the strip 3 which is passed through the arrangement in the direction indicated by the double headed arrow. The above-mentioned spacing between the blocks is maintained by mechanical means (not shown) which preferably also permit a variation in the block spacing so that the apparatus according to the invention can be adapted to receive different thicknesses of a strip 3 which is to be passed therethrough, or in order to alter the squeeze pressure of the rollers 4 and 5. Many kinds of known mechanical means present themselves to the man skilled in the art for the purposes of maintaining and varying the block spacing. Such mechanical means are not included in the subject-matter of the present invention.

The material making up the blocks 1, 2 and the squeeze rollers 4 and 5 depends on the strip material to be treated. Thus it is possible for example to use metal and/or plastics materials.

The blocks 1 and 2 may comprise solid material, but also, in order to reduce their weight, they may be in the form of hollow blocks. The blocks also do not need to comprise a single coherent piece of material but they may be made up of individual portions. Therefore, the term "block" in this description is to be interpreted as meaning not only a solid block but also a hollow block or a structure which is composed of individual portions. The only important consideration is that such a structure is of the external configuration described herein, with openings 6, as well as the configurations which are further to be described hereinafter.

Figure 3:
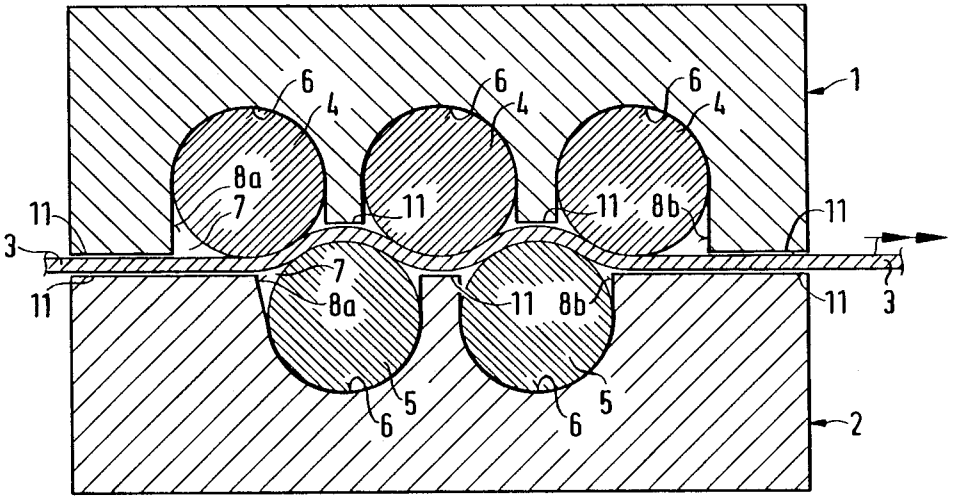
FIG. 3 is a diagrammatic view in longitudinal section through another embodiment of a film removal apparatus according to the invention.

FIG. 3 shows a modified embodiment of the apparatus according to the invention in which the upper rollers 4 and the lower rollers 5 in the openings 6 in the blocks 1 and 2 are not in mutually opposing relationship but are arranged in longitudinally displaced relationship relative to each other in the direction of movement of strip 3 as indicated by the double headed arrow. That embodiment provides a different number of lower squeeze rollers 5 and, as for example in the construction shown in FIG. 3, may permit the strip 3 to be passed through the apparatus in a wavy configuration, which however does not in any way alter the operating principle of the different embodiments.

Instead of using three pairs of squeeze rollers, as shown in the embodiment in FIG. 1, it is also possible to provide fewer or more pairs of squeeze rollers. Likewise, in the embodiment shown in FIG. 3, instead of the five squeeze rollers shown, it is also possible to use three, seven, nine etc. squeeze rollers.

The above-mentioned openings 6, in whose rounded inner base surface the squeeze rollers 4 and 5 rest, have substantially flat side surfaces 8*a* and 8*b* that extend from the rounded base surface toward the strip 3 and are substantially tangent to the rounded base surface of opening 6 as viewed in cross section and as best seen in FIG. 1. In that connection, a side surface 8*a* which lies upstream of a squeeze roller as considered in the direction of movement of the strip (as indicated by the double headed arrow), together with the respective surface regions of the strip 3 and the respective surface regions of the squeeze roller, forms a transversely extending air flow duct 7, as can best be seen from FIG. 3, which is of generally triangular cross section.

Now, both on the top and the underside of the strip, an air flow can be passed through the air flow duct 7 from one edge of the strip to the other, and the air flow may be produced by a pressure force or a suction force. The air flow then carries the flow agent which collects in the duct 7, due to the squeeze action of the rollers, out of the duct 7. The conveying effect is increased with an increasing speed of the air flow or with a reduction in the cross section of the duct 7.

The blocks 1 and 2 have surfaces 11 between adjacent rolls 4 and 5, respectively, which surfaces face toward the top side and the underside, respectively, of the strip 3. On the one hand the surfaces 11 are not intended to contact the surface of the strip, in order to avoid damaging it, while on the other hand the spacing between the surfaces 11 and the strip 3 should be kept at a minimum value as the gap formed thereby represents a certain "leakiness" in respect of the duct 7, which adversely affects the conveying action of the air flow if that gap is of substantial width.

If the conveying air flow is produced by means of compressed air, then the air flow may drive a small part of the flow agent which is squeezed off the strip, into the above-mentioned gap between the surface of the strip and the block surface 11 while on the other hand when using suction air, any residues of flow agent that may still be present in that gap can be effectively removed. That is one of the major reasons why, in the present invention, the air flow which is directed against the cushions of flow agent which are squeezed off the strip are preferably produced by a suction means.

The use of suction air also facilitates the subsequent separation, which is preferably provided, of the flow agent-air-mixture which is discharged from the air flow ducts 7, to break it down into its components, in a suitable downstream-disposed filter or cyclone (not shown).

Figure 2:
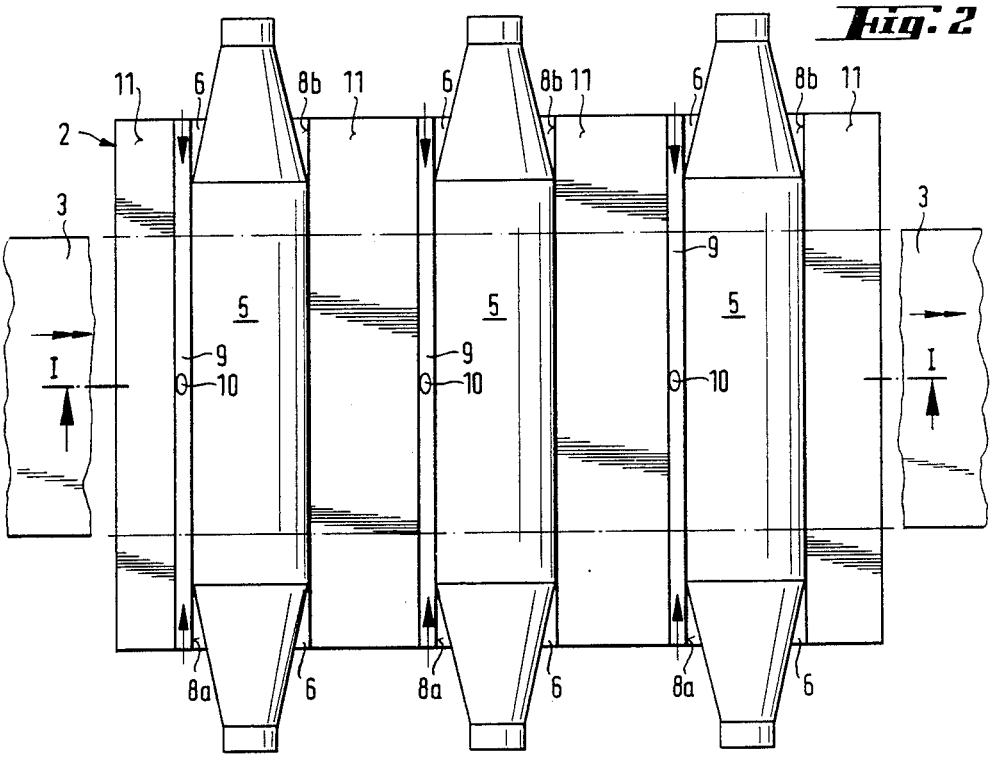
FIG. 2 is a plan view of the bottom block of the apparatus shown in FIG. 1, with rollers, after removal of the upper block together with the rollers thereof and the strip to be treated.

If there is a possibility of a large amount of flow agent which has been squeezed off the strip blocking up the air flow duct, then it is advantageous for a longitudinal groove 9 (FIGS. 1 and 2) to be provided in the wall portion 8*a* of the air flow duct 7. Such a groove 9 may extend over a small part of the height of the wall portion 8*a* (FIG. 1) transverse to strip 3, but it may also extend over the entire height thereof (FIG. 4), that is to say, the groove 9 replaces the wall portion 8*a*.

In the apparatus according to the invention, a conduit 10 (FIGS. 1 and 2) can be positioned to open in the middle of each air flow duct 7, relative to the width of strip 3, or in the middle of each said groove 9, respectively, which conduit 10 extends outwardly through the blocks 1 and 2 with a source of suction being connected to the outer end thereof. The air flow in the ducts 7 then follows the path indicated by the several arrows in FIGS. 1 and 2. It passes into the air flow duct 7 at both transverse edges of the strip, and is drawn off outwardly through the conduit 10 from the middle of the duct 7, with the entrained flow agent.

Figure 4:
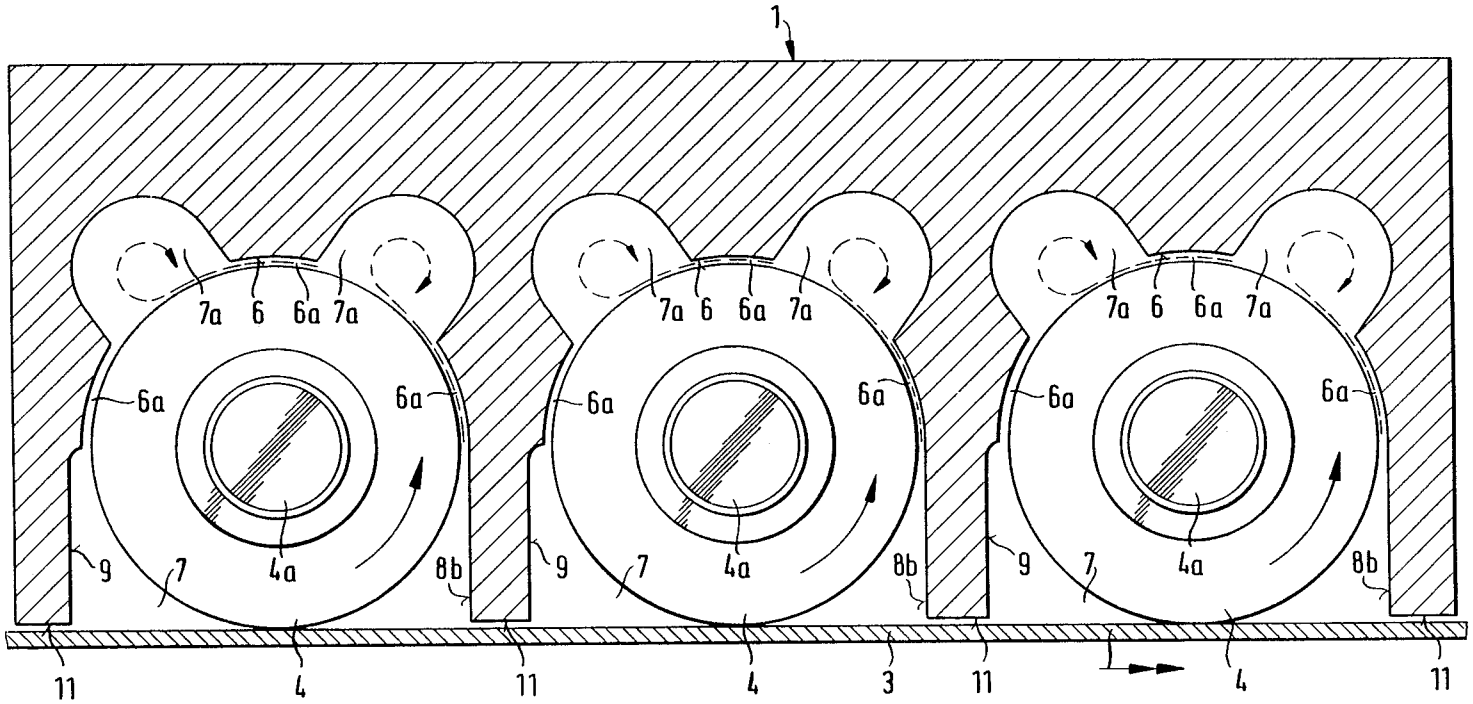
FIG. 4 is a diagrammatic view in longitudinal section through an upper block with rollers and the strip to be treated, in yet another embodiment of a film removal apparatus according to the invention.

In the preferred embodiment of the apparatus according to the invention, as shown in FIG. 4 (bottom block 2 with associated squeeze rollers 5 is not shown), the squeeze rollers 4 and 5 each have respective mounting spindles or shafts, such as shafts 4*a*, which are mounted in such a way that a radial clearance 6*a* is provided between the rounded base surfaces of the openings 6 and the outer cylindrical surfaces of the rollers 4 and 5. Disposed in the region of the rounded inner surfaces of the openings 6 are two additional air flow ducts 7*a* which are positioned radially outwardly of rollers 4 and 5 and which extend transversely with respect to the forward feed movement of the strip 3. Residues of flow agent which may possibly still cling to the surface of the rollers after the squeeze operation are thrown off into the ducts 7*a* (see the broken-line arrows in FIG. 4) by the centrifugal force which is generated due to the rapid rotary movement of the rollers, and are entrained by the air flows in the ducts 7*a* and are withdrawn through suitable conduits (not shown) similar to conduits 10 shown in FIG. 1. That additional withdrawal duct area provided by ducts 7*a* gives rise to a further increase in the level of efficiency of the apparatus according to the invention.

Although particular embodiments of the invention have been illustrated and described, it will be apparent to those skilled in the art that various changes and modifications can be made without departing from the spirit of the present invention, and it is intended to encompass within the appended claims all such changes and modifications that fall within the scope of the present invention.

What is claimed is:

1. Apparatus for removing films of flow agent clinging to moving strip material, said apparatus comprising: a pair of squeeze rollers positioned on opposite sides of a movable strip and in contact therewith for squeezing away films of flow agent clinging to surfaces of the strip, and air flow ducts extending transversely with respect to a forward feed direction of the strip and provided at points of entry of the strip into squeeze regions upstream of the rollers, wherein in said squeeze regions the surfaces of both the strip material and of the squeeze rollers define walls of the air flow ducts, the apparatus including upper and lower blocks adjacent to respective upper and lower sides of the strip and having elongated openings facing the strip and extending transversely thereof, at least one upper squeeze roller positioned in a transverse opening in the upper block and at least one lower squeeze roller positioned in a transverse opening in the lower block, the openings having substantially flat side surfaces extending from the respective squeeze roller toward the strip and the side surfaces that lie upstream of a squeeze roller, as considered in the feed direction of the strip, together with respective adjacent surface regions of the strip and the respective adjacent surfaces of the squeeze rollers define substantially contiguous walls of said air flow ducts.

2. Apparatus according to claim 1, wherein the upper squeeze roller and lower squeeze roller are disposed in mutually opposing relationship.

3. Apparatus according to claim 1, wherein the upper squeeze roller and the lower squeeze roller are arranged in displaced relationship relative to each other as considered in the direction of movement of the strip.

4. Apparatus according to claim 1 wherein a conduit opens centrally of each upstream side surface, said conduit extending outwardly through the blocks, and suction means communicating with an outer end of the conduit for removing flow agent therefrom.

5. Apparatus for removing films of flow agent clinging to moving strip material, said apparatus comprising: a pair of squeeze rollers positioned on opposite sides of a movable strip and in contact therewith for squeezing away films of flow agent clinging to surfaces of the strip, and air flow ducts extending transversely with respect to a forward feed direction of the strip and provided at points of entry of the strip into squeeze regions upstream of the rollers, wherein in said squeeze regions the surfaces of both the strip material and of the squeeze rollers define walls of the air flow ducts, the apparatus including upper and lower blocks adjacent to respective upper and lower sides of the strip and having elongated openings facing the strip and extending transversely thereof, at least one upper squeeze roller positioned in a transverse opening in the upper block and at least one lower squeeze roller positioned in a transverse opening in the lower block, the openings having substantially flat side surfaces extending from the respective squeeze roller toward the strip and the side surfaces that lie upstream of a squeeze roller, as considered in the feed direction of the strip, together with respective adjacent surface regions of the strip and the respective adjacent surfaces of the squeeze rollers define walls of said air flow ducts, wherein said transverse openings receive said squeeze rollers and each transverse opening includes a curved base surface spaced from the strip and having a curvature sufficient to rotatably receive a squeeze roller therein.

6. Apparatus according to claim 5 including suction means in communication with said air flow ducts for causing air to flow through the ducts.

7. Apparatus according to claim 5 including longitudinal grooves formed in upstream side surfaces of the openings in the blocks that define a wall of the air flow ducts.

8. Apparatus according to claim 7 wherein the longitudinal grooves extend over the entire transverse extent of the side surfaces.

9. Apparatus according to claim 5, wherein the squeeze rollers include mounting spindles at respective ends thereof, and said rollers are mounted to provide a clearance between the curved base surfaces of the transverse openings and outer surfaces of the rollers, and at least one additional air flow duct extending transversely with respect to the forward feed direction of the strip and outwardly of and in communication with said curved base surface for entrainment of flow agent residues that cling to the roller outer surface and are thrown off by centrifugal force.

* * * * *